United States Patent [19]

Kelsey, Jr. et al.

[11] 4,446,645

[45] May 8, 1984

[54] CARTRIDGE MAGAZINE AND FOLLOWER FOR AUTOLOADING FIREARMS

[75] Inventors: Charles C. Kelsey, Jr., Chesterland, Ohio; Walter C. Wolff, Berwyn, Pa.

[73] Assignee: Devel Corporation, Chesterland, Ohio

[21] Appl. No.: 348,663

[22] Filed: Feb. 12, 1982

[51] Int. Cl.[3] ..... F41C 25/02

[52] U.S. Cl. ..... 42/50

[58] Field of Search ..... 42/50, 7, 18, 22

[56] References Cited

U.S. PATENT DOCUMENTS

| | | | |
|---|---|---|---|
| 1,128,180 | 2/1915 | Orman | 42/7 |
| 1,158,981 | 11/1915 | Carl | 42/50 |
| 2,441,735 | 5/1948 | Warner | 42/50 |
| 2,944,357 | 7/1960 | Smith et al. | 42/50 |

*Primary Examiner*—Charles T. Jordan

[57] ABSTRACT

A cartridge magazine and follower for firearms in which the follower is provided with a spring-action in addition to that of the follower spring. As cartridges are loaded into the magazine the follower itself is compressed, thereby providing more space within the magazine for one or more additional cartridges without basically changing the dimensions of the magazine.

7 Claims, 5 Drawing Figures

Fig. 1.
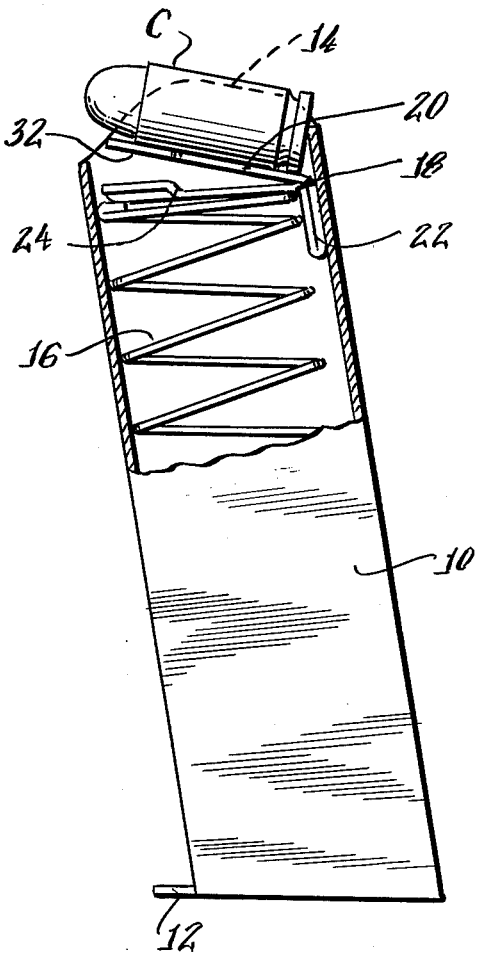
Fig. 2.
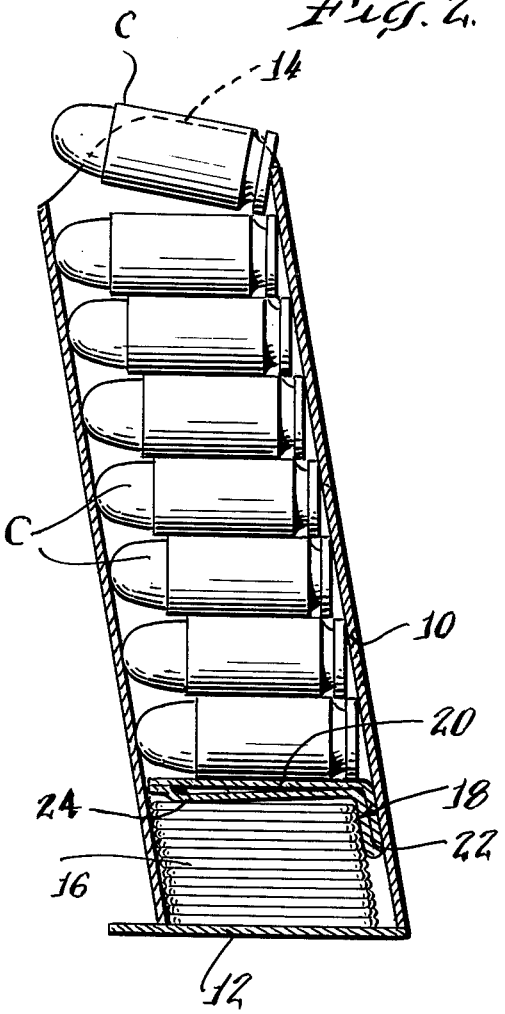
Fig. 4.
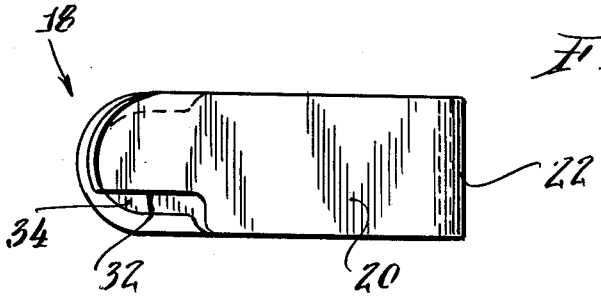
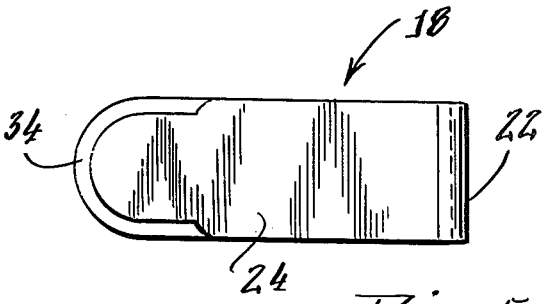
Fig. 5.
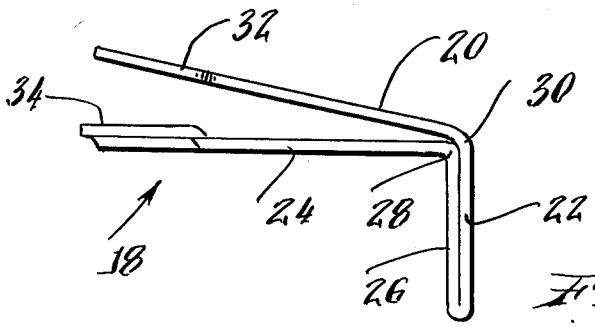
Fig. 3.

CARTRIDGE MAGAZINE AND FOLLOWER FOR AUTOLOADING FIREARMS

BACKGROUND OF THE INVENTION

The invention relates to cartridge magazines for automatic firearms, and to cartridge followers for so-called box magazines, in which the cartridges are arranged side-by-side in one or more columns for movement laterally of themselves toward the open end of the magazine from which each round is fed into the cartridge chamber by the slide or bolt member.

In conventional magazines of this type, such as those used in the United States Government Model 1911 .45 caliber automatic pistol, commonly referred to as the Colt .45, a single column of cartridges is disposed within an elongated tube that is closed at the lower end. The cartridges are urged upward by a spring which is compressed between the bottom of the magazine and a follower which engages the lower-most cartridge in the column. In most cases, the follower is a rigid, usually sheet-metal member, having a cartridge-engaging portion that is disposed transversely of the magazine tube but longitudinally of the cartridges. A positioning and guide portion at its rear extends downward along the wall of the magazine tube. In the follower of the Government Model 1911, the forward end of the cartridge-engaging portion also has a depressed step or tab for actuating the slidestop of the pistol when the last round is fired, so that the slide is automatically held open when the magazine is empty. Due to space limitations imposed by the length and width of the pistol grip, or of the receiver in an automatic rifle or shotgun, magazines for these guns have heretofore been designed to hold a specified maximum number of rounds. In the case of the Goverment Model 1911 types, prior magazines have been capable of holding only seven rounds.

The object of the present invention is to increase the capacity of cartridge magazines of this type without changing the outside dimensions of the magazine tube, so that it is usable in existing weapons without any modification of the gun.

SUMMARY OF THE INVENTION

In accordance with one aspect of the invention, the follower is made of spring steel or other suitable material formed with a cartridge-engaging portion extending transversely of the longitudinal axis of the magazine and an integral tab at its rear end which extends at the desired angle toward the closed end of the magazine to provide means for holding the cartridge-engaging portion at the correct angle within the magazine and guiding it as it travels longitudally of the magazine. The cartridge-engaging portion forms a leaf-spring which yields under the pressure of the cartridges as they are loaded into the open end of the magazine, such that the cartridge-engaging portion is depressed into the space adjacent the positioning and guide tab, thereby providing additional space for cartridges within the magazine.

Instead of providing a step at the forward end of the cartridge-engaging portion of the follower in the conventional manner for actuating the slide-stop of the Government Model 1911, it is desirable in accordance with another aspect of the invention to provide a finger portion that is integral with the guide tab and extends forwardly therefrom below the cartridge-engaging portion. The outer end of the finger portion is disposed at the proper distance below the cartridge-engaging member so that it contacts and actuates the slide-stop lever on the gun following discharge of the last round.

In another important aspect of the invention, additional space for cartridges is provided not only by making the cartridge-engaging portion of the follower resilient as hereinbefore mentioned, but also by providing a lighter follower spring having a reduced solid height so that it does not occupy as much space when fully compressed. Despite the fact that the follower spring is lighter than that of a standard one for an existing firearm, the forces exerted by the resilient follower in conjunction with the modified follower spring produce better results both at fully loaded and partially loaded conditions of the magazine as compared with a standard magazine assembly for autoloading weapons, such as the Colt .45.

DETAILED DESCRIPTION OF PREFERRED EMBODIMENT

The invention will be more apparent from the following description of a particularly desirable embodiment thereof in a cartridge magazine for a Government Model 1911 automatic pistol, referred to herein as a Colt .45, reference being had to the accompanying drawings, wherein FIG. 1 is a side elevational view with parts broken away and in section, showing a conventional cartridge magazine for a Colt .45, but having a follower constructed in accordance with the present invention, the last cartridge being shown in position prior to its being fed into the firing chamber of the pistol;

FIG. 2 is a view similar to FIG. 1, but in full vertical section and showing the magazine completely loaded with eight rounds;

FIG. 3 is an enlarged side elevational detail view of the follower shown in FIGS. 1 and 2;

FIG. 4 is a top plan view of the follower shown in FIG. 3, and

FIG. 5 is a bottom plan view thereof.

Referring to the drawings, the cartridge magazine has an elongated tube 10, which is substantially identical to conventional magazines which fit into the grip of a Colt .45 automatic pistol. The lower end of tube 10 is closed by a bottom plate 12, which is spot-welded or otherwise permanently and rigidly fastened to the sheet-metal walls of tube 10. The open upper end of tube 10 is provided with inwardly turned retaining lips 14, against which the uppermost cartridge C is urged by a magazine spring 16. The front wall of magazine tube 10 is cut away to permit the cartridge C to move endwise out of the magazine as it is driven in the usual manner into the cartridge chamber of the pistol by the slide.

Magazine spring 16 is compressed between the bottom plate 12 of tube 10 and a cartridge follower (designated generally at 18) which engages the lowermost cartridge in a single column, urging the cartridges upward against the retaining lips 14 at the open end of the magazine.

As hereinbefore mentioned no magazine for the Government Model 1911 or Colt .45 has to our knowledge been designed which, as a practical matter, can hold and dispense more than seven rounds. The obvious ways of increasing the capacity of a magazine would be to lengthen the tube or alternatively to increase its width so that it can hold two columns or a staggered column. But neither of these modifications are acceptable, because it would require lengthening or widening the grip of the pistol. On the other hand, more cartridges could of course be accommodated within the same available space if the magazine spring could be made to occupy less space within the magazine when it is fully compressed to its solid height. But up to now it has not been feasible to do this with existing technology and materials while still providing the necessary force to deliver all the cartridges in the column. However, we have found that by making the cartridge follower resilient independently of the follower spring so that the spring-action of the follower itself complements that of the follower spring, the total force exerted by the combined action of the follower and follower spring in unison can greatly enhance the function of the magazine both in delivering the cartridges and in actuating a slide-open stop, if one is provided. Furthermore, such enhanced spring-action makes it possible to provide additional space within the magazine for cartridges by employing a follower spring having a reduced solid height, which therefore does not occupy as much space when fully compressed as compared with the corresponding spring in a standard magazine for an existing weapon.

In some instances, the cartridge follower can be designed so that it can be compressed enough to provide space for at least one additional cartridge within a magazine tube having basically the same outside dimensions as the original magazine for the particular gun involved. In others, however, it is necessary to reduce the solid height of the follower spring and the length of the positioning and guide portion of the follower in addition to making the follower itself resilient. Thus, magazines for the Colt .45, for example, can be provided with a follower 18 of our design as shown in the accompanying drawings, in which the cartridge-engaging portion 20 is resilient with respect to a rigid positioning tab 22, which extends downward from the rear end of portion 20 behind the upper coils of magazine spring 16. In this instance, the follower is made of a flat strip of spring-steel, so that the portion 20 acts like a leaf-spring to bend downward as the cartridges are loaded into the magazine from the position shown in FIG. 1 to the position shown in FIG. 2.

The flat stock of which the follower 18 is made is bent sharply back and upward against itself at the bottom of guide tab 22, which is therefore substantially rigid due to the double-layer of the material in this area. The single-layer cartridge-engaging portion 20, on the other hand, flexes at its juncture with tab 22. Follower 18 is also provided with a finger-portion 24, which extends forward from the upper end of tab 22 below the portion 20 and is formed by an extension of the upwardly bent inner layer 26 of the material forming tab 22. As best seen in FIG. 3, the finger-portion 24 is disposed at substantially 90° to the tab 22, while the cartridge-engaging portion 20 is disposed at 13° relative to portion 24 in order to position the cartridges at the desired angle for a Colt .45 automatic pistol. It will also be noted that the right-angle bend 28 between the finger-portion 24 and inner layer 26 of tab 22 is located immediately adjacent and inward of the bend 30 at which portion 20 is joined to the outer layer of tab 22. The bend 28 accordingly supports the portion 20 at the point where it joins tab 22, while portion 20 is permitted to flex downward toward the finger-portion 24.

Accordingly, the follower 18 is made of a single elongated strip of sheet metal, preferrably spring steel, one end-section of which forms the cartridge-engaging portion 20. The sheet-metal strip has a first bend 30 of less than 90° at the inner end of the portion 20 and a second bend of 180° at the bottom of the guide tab 22, so that a double-layer of material is provided in order to make tab 22 rigid. The slide-stop actuating finger 24 is formed by the other end-section of the strip by bending it at 28 at the upper end of the guide tab 22 immediately below the cartridge-engaging portion 20.

As shown in FIG. 4, the cartridge-engaging portion 20 is provided with a cut-out 32 at its outer end on one side, so that it by-passes the slide-stop lever on the Colt .45 pistol when one round remains in the magazine. Premature actuation of the slide-stop is thereby avoided. However, when follower 18 moves upward against retaining lips 14 upon chambering of the last cartridge C from the magazine, finger-portion 24 contacts the slide-stop lever on the pistol actuating it in the same manner that the step on a conventional follower operates. As seen in FIGS. 3 and 5, the outer end of finger-portion 24 is bevelled upward along its edges 34 so that it does not catch on the upper front edge of the magazine when the first round is loaded into an empty magazine.

As will be noted in FIG. 2, the cartridge-engaging portion 20 of follower 18 is compressed flush against the slide-stop actuating finger 24 when the magazine is fully loaded, thereby providing the additional space required for eight rounds instead of seven. In addition, the positioning and guide tab 22 of follower 18 must be shorter than the solid height of the follower spring 16, permitting the coils to press substantially solidly one against the other when the eighth round is loaded into the magazine tube.

In this particular instance the follower spring 16 has been modified as compared to the follower spring in conventional cartridge magazines for the Colt .45 by reducing the wire diameter and number of coils, thereby reducing the solid height of the coil spring. This provides space in addition to that provided by the resilient cartridge-engaging portion 20 of follower 18. It should be emphasized, however, that modification of the follower spring 16 alone is not feasible, nor would it provide the required additional space for another cartridge in a Colt .45 magazine. If a follower spring having a smaller wire diameter and fewer coils were substituted for the follower spring in a conventional Colt .45 magazine, the spring would be too weak to deliver the last cartridges in the magazine against the retaining lips with the required force to ensure proper chambering of the cartridges, as well as to actuate the slide-open stop of such a weapon. However, by employing the resilient follower of the present invention, the additional spring force provided by the follower reinforces the weaker spring and actually improves the function of the follower spring. On the other hand, in magazines other than those for the Colt .45, it is possible to provide the necessary space for an additional round solely by providing spring-action in the follower itself in lieu of the rigid follower employed heretofore.

We claim:

1. An improved box-type cartridge magazine for an autoloading firearm of existing design comprising a magazine tube closed at one end and having substantially the same dimensions as the corresponding magazine tube for said existing design, a modified cartridge-follower spring formed of coiled spring-wire having a solid height which is less than that of the corresponding follower spring for said existing design, a cartridge follower comprising a cartridge-engaging portion and means for positioning and guiding said portion extending longitudinally of said magazine tube toward the closed end thereof, said cartridge-engaging portion comprising a leaf-spring which is resilient relative to said positioning and guide means such that it yields longitudinally of said magazine as cartridges are loaded into said magazine, said positioning and guide means being formed integrally with said cartridge-engaging portion at one end thereof.

2. An improved box-type cartridge magazine as defined in claim 1, wherein said positioning and guiding means comprises a portion extending from said cartridge-engaging portion toward said closed end of said magazine tube no more than the solid height of said modified follower spring.

3. A cartridge follower for box-type magazines for automatic firearms, comprising a cartridge-engaging portion, means for positioning and guiding said portion when mounted for use in a magazine, said positioning and guide means extending longitudinally of the magazine in a direction opposite to the direction in which the cartridges are urged by said follower, said cartridge-engaging portion comprising a leaf-spring which is resilient relative to said positioning and guide means, such that it yields longitudinally of the magazine as cartridges are loaded into said magazine, said positioning and guide means being formed integrally with said cartridge-engaging portion at one end thereof.

4. A cartridge follower as defined in claim 3, which further includes a slide-stop actuating finger formed integrally with said positioning and guide means and extending in spaced relation to said cartridge-engaging portion on the side thereof which is in said opposite direction at a predetermined distance therefrom.

5. A cartridge follower as defined in claim 4, wherein said follower is constructed of a single elongated strip of spring steel one end-section of which forms said cartridge-engaging portion, said elongated strip having a first bend of less than 90° to form said one end-section and a second bend at a predetermined distance from said first bend of substantially 180° toward said cartridge-engaging portion, thereby forming a section having a double-layer of material which comprises said positioning and guide means, said elongated strip having a third bend of substantially 90° adjacent said first bend to form said slide-stop actuating finger.

6. A cartridge follower as defined in claim 5, wherein said third bend is located immediately adjacent and in contact with said first bend, such that said one end of said cartridge-engaging portion is supported by the corresponding end of said slide-stop actuating finger.

7. A cartridge follower as defined in claim 3, wherein said follower is constructed of a single elongated strip of spring steel one end-section of which forms said cartridge-engaging portion, said elongated strip having a first bend which forms said one end-section and a second bend of substantially 180° toward said cartridge-engaging portion at a predetermined distance from said first bend, thereby forming a section having a double-layer of material which comprises said positioning and guide means.

* * * * *